US012550973B2

(12) United States Patent
Hadiati et al.

(10) Patent No.: US 12,550,973 B2
(45) Date of Patent: Feb. 17, 2026

(54) SOLE STRUCTURE FOR ARTICLE OF FOOTWEAR

(71) Applicant: NIKE, Inc., Beaverton, OR (US)

(72) Inventors: Jekti Hadiati, Beaverton, OR (US); Jesse Olsen, Portland, OR (US); Kevin Reyes, Beaverton, OR (US); Kyoungmin Song, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/773,375

(22) Filed: Jul. 15, 2024

(65) Prior Publication Data

US 2025/0040655 A1 Feb. 6, 2025

Related U.S. Application Data

(60) Provisional application No. 63/517,041, filed on Aug. 1, 2023.

(51) Int. Cl.
*A43B 13/14* (2006.01)
*A43B 13/37* (2006.01)

(52) U.S. Cl.
CPC ..... *A43B 13/14* (2013.01); *A43B 13/37* (2013.01)

(58) Field of Classification Search
None
See application file for complete search history.

(56) References Cited

U.S. PATENT DOCUMENTS 4,372,059 A * 2/1983 Ambrose ..... A43B 13/184 36/103
RE31,173 E * 3/1983 Daswick ..... A43B 13/182 36/114
6,986,183 B2 * 1/2006 Delgorgue ..... A43B 23/0215 36/98
8,291,615 B2 * 10/2012 Kita ..... A43B 13/143 36/27
8,567,093 B2 * 10/2013 Sato ..... A43B 13/12 36/27
9,289,028 B1 * 3/2016 Anderson ..... A43B 7/148
(Continued)

FOREIGN PATENT DOCUMENTS

EP 2446768 A2 5/2012

OTHER PUBLICATIONS

European Patent Office (ISA), International Search Report and Written Opinion for PCT App. No. PCT/US2024/038185, mailed Oct. 22, 2024.

*Primary Examiner* — Jila M Mohandesi
(74) *Attorney, Agent, or Firm* — Honigman LLP; Matthew H. Szalach; Jonathan P. O'Brien

(57) ABSTRACT

A sole structure for an article of footwear includes a midsole having a first surface, a second surface disposed on an opposite side of the midsole than the first surface and opposing a ground surface during use, and a sidewall extending between and connecting the first surface and the second surface, the sidewall including (i) a first portion extending along one of a medial side of the sole structure and a lateral side of the sole structure and including a first concave portion in a forefoot region and a convex portion in a heel region and (ii) a second portion extending along the other of the medial side of the sole structure and the lateral side of the sole structure and including a second concave portion extending from the forefoot region to the heel region.

20 Claims, 9 Drawing Sheets

(56) References Cited

U.S. PATENT DOCUMENTS

| | | | | |
|---|---|---|---|---|
| 10,231,513 | B1 * | 3/2019 | Lucca | A43B 13/12 |
| 2011/0179678 | A1 * | 7/2011 | Shiao | A43B 13/145 12/146 B |
| 2013/0118035 | A1 | 5/2013 | Segato et al. | |
| 2016/0345668 | A1 * | 12/2016 | Dyer | A43B 13/186 |
| 2018/0338572 | A1 * | 11/2018 | Cross | A43B 13/04 |
| 2019/0142108 | A1 * | 5/2019 | Youngs | A43B 13/04 36/28 |
| 2019/0223553 | A1 * | 7/2019 | Lussier | A43B 13/26 |
| 2021/0227933 | A1 * | 7/2021 | Farina | A43B 13/04 |
| 2021/0401114 | A1 * | 12/2021 | Mahoney | A43B 13/141 |
| 2022/0369763 | A1 * | 11/2022 | Behnamian | A61H 15/00 |
| 2023/0027940 | A1 | 1/2023 | Diard et al. | |

* cited by examiner

SOLE STRUCTURE FOR ARTICLE OF FOOTWEAR

CROSS REFERENCE TO RELATED APPLICATIONS

This application claims priority under 35 U.S.C. § 119 (e) to U.S. Provisional Application No. 63/517,041, filed on Aug. 1, 2023. The disclosure of this prior application is considered part of the disclosure of this application and is hereby incorporated by reference in its entirety.

FIELD

The present disclosure relates generally to a sole structure for an article of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may incorporate a fluid-filled bladder to provide cushioning to the foot by compressing resiliently under an applied load to attenuate ground-reaction forces. Sole structures may also include a comfort-enhancing insole or sockliner located within a void proximate to the bottom portion of the upper and a strobel attached to the upper and disposed between the midsole and the insole or sockliner.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
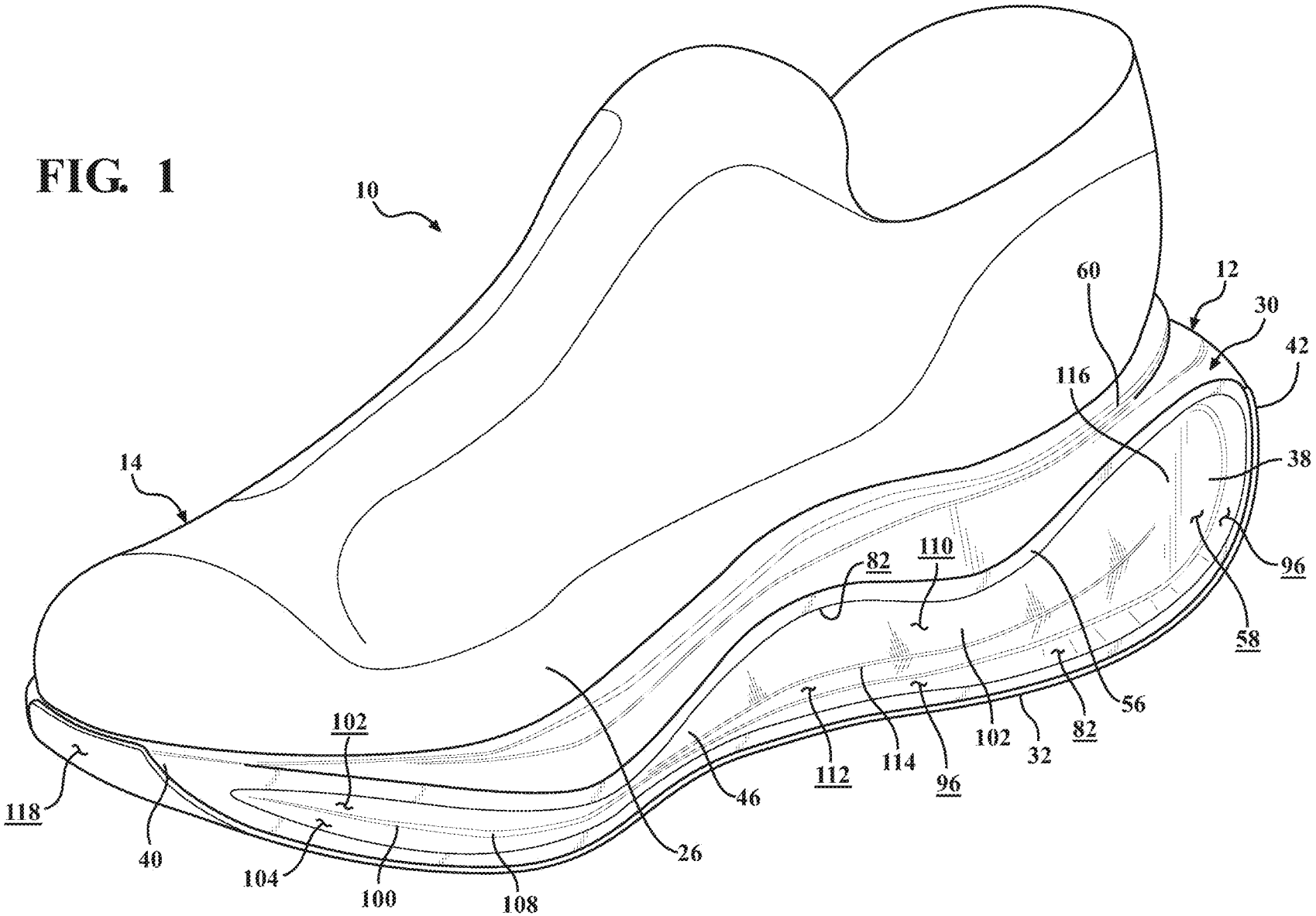
FIG. 1 is a lateral side perspective view of an article of footwear including an example of a sole structure in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a midsole having a first surface, a second surface disposed on an opposite side of the midsole than the first surface and opposing a ground surface during use, and a sidewall extending between and connecting the first surface and the second surface, the sidewall including (i) a first portion extending along one of a medial side of the sole structure and a lateral side of the sole structure and including a first concave portion in a forefoot region and a convex portion in a heel region and (ii) a second portion extending along the other of the medial side of the sole structure and the lateral side of the sole structure and including a second concave portion extending from the forefoot region to the heel region.

The sole structure may include one or more of the following optional features. For example, the first concave portion may be aligned with the second concave portion across a width of the sole structure. Additionally or alternatively, the convex portion may be disposed in the heel region of the sole structure. The convex portion may extend from a midfoot region of the sole structure into a heel region of the sole structure. Further, the first concave portion may extend continuously from the forefoot region to a midfoot region of the sole structure and the convex portion may extend continuously from the first concave portion into the heel region.

In one configuration, the first concave portion may be defined by a first substantially planar surface and a second substantially planar surface that meet at a first junction to define a depth of the first concave portion. In this configuration, the convex portion may be defined by a third substantially planar surface and a second substantially planar surface that meet at an apex to define a height of the convex portion. The apex may be aligned with the first junction of the first concave portion. Further, the second concave portion may be defined by a fifth substantially planar surface and a sixth substantially planar surface that meet at a second junction to define a depth of the second concave portion, the second junction being aligned with the apex of the convex portion across a width of the sole structure.

An article of footwear may incorporate the sole structure.

In another configuration, a sole structure for an article of footwear includes a midsole having a first surface, a second surface disposed on an opposite side of the midsole than the first surface and opposing a ground surface during use, and a sidewall extending between and connecting the first surface and the second surface, the sidewall including (i) a first portion extending along one of a medial side of the sole structure and a lateral side of the sole structure and including a first concave portion in a forefoot region and a convex portion in a heel region and (ii) a second portion extending along the other of the medial side of the sole structure and the lateral side of the sole structure and including a second concave portion aligned with the first concave portion and the convex portion across a width of the sole structure.

The sole structure may include one or more of the following optional features. For example, the first concave portion and the second concave portion may have substantially the same size and shape. Additionally or alternatively, the convex portion may be disposed in the heel region of the sole structure. The convex portion may extend from a midfoot region of the sole structure into a heel region of the sole structure. Further, the first concave portion may extend continuously from the forefoot region to a midfoot region of the sole structure and the convex portion may extend continuously from the first concave portion into the heel region.

In one configuration, the first concave portion may be defined by a first substantially planar surface and a second substantially planar surface that meet at a first junction to define a depth of the first concave portion. In this configuration, the convex portion may be defined by a third substantially planar surface and a second substantially planar surface that meet at an apex to define a height of the convex portion. The apex may be aligned with the first junction of the first concave portion. Further, the second concave portion may be defined by a fifth substantially planar surface and a sixth substantially planar surface that meet at a second junction to define a depth of the second concave portion, the second junction being aligned with the apex of the convex portion across a width of the sole structure.

An article of footwear may incorporate the sole structure.

Figure 5:
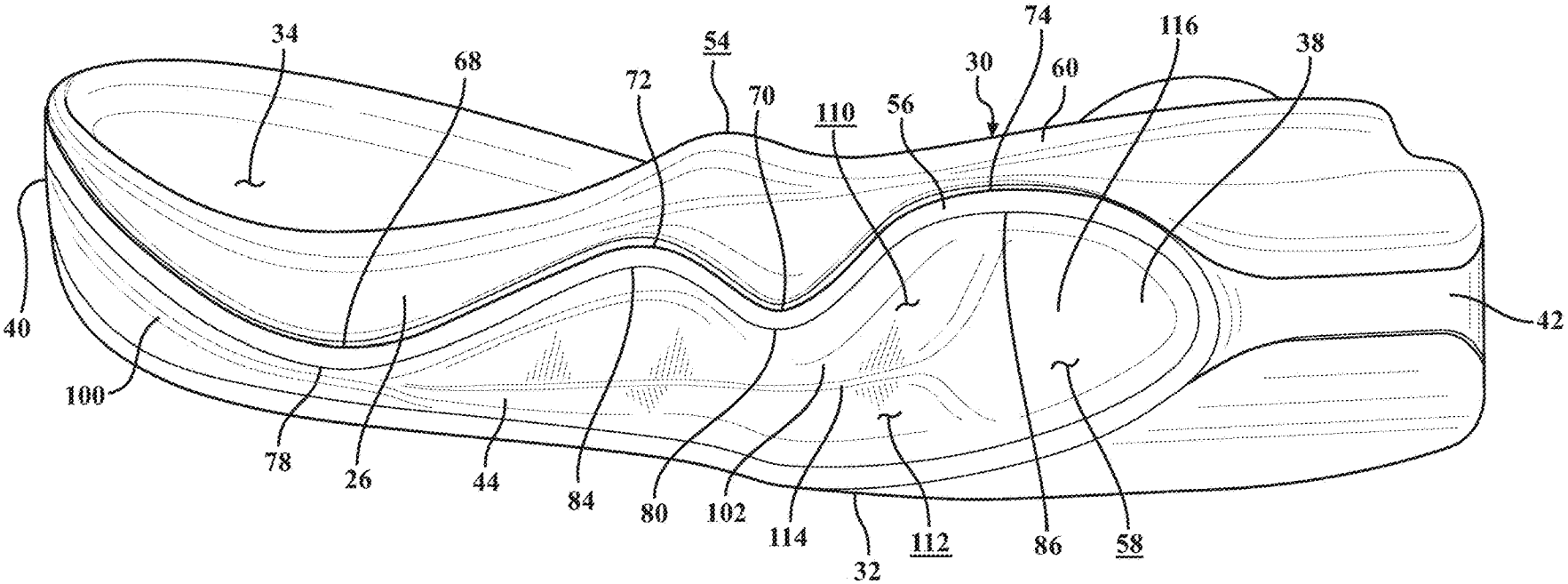
FIG. 5 is a medial rear perspective view of the sole structure of FIG. 1.
Figure 6:
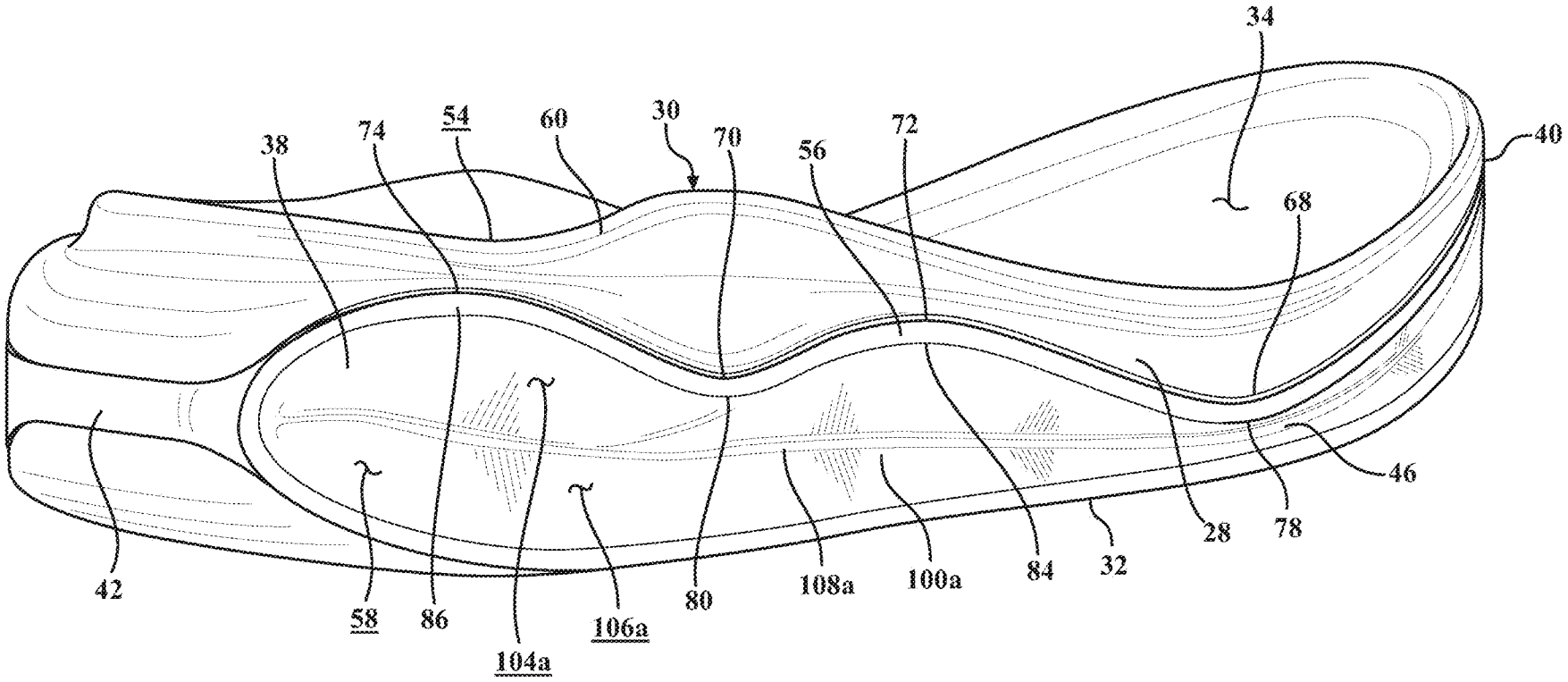
FIG. 6 is a lateral rear perspective view of the sole structure of FIG. 1.
Figure 7:
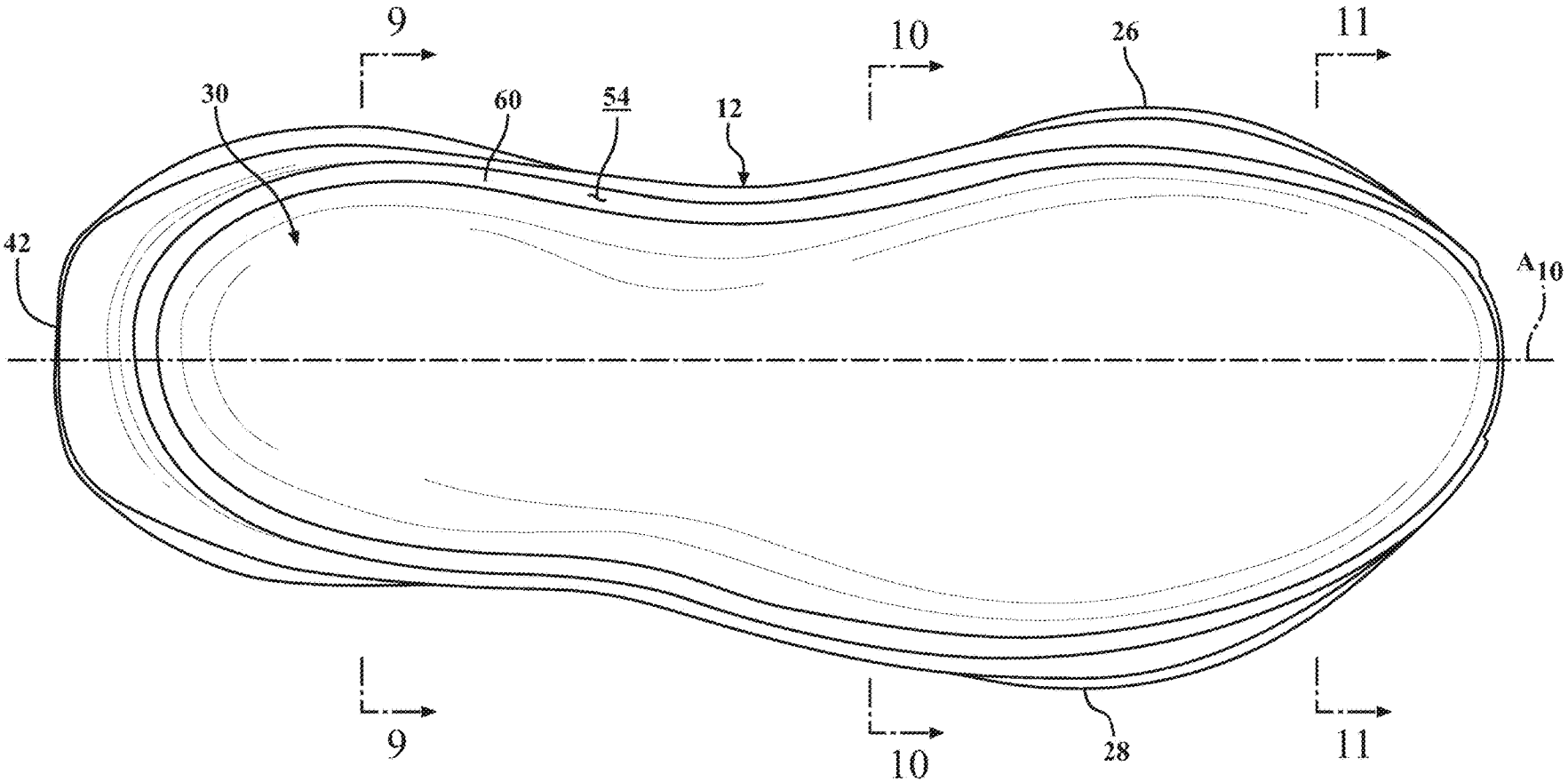
FIG. 7 is a top plan view of the sole structure of FIG. 1.

Referring to FIGS. 1-8, an article of footwear 10 is provided, and includes a sole structure 12 and an upper 14 attached to the sole structure 12. The article of footwear 10 may be divided into one or more regions. The regions may include a forefoot region 16, a midfoot region 18, and a heel region 20. The forefoot region 16 may include a toe portion $\mathbf{16}_T$ corresponding to the phalanges and a ball portion $\mathbf{16}_B$ corresponding to the metatarsophalangeal joint (i.e., "the ball") of the foot. The midfoot region 18 may correspond with an arch area of the foot, and the heel region 20 may correspond with rear portions of the foot, including a calcaneus bone. The footwear 10 may further include an anterior end 22 associated with a forward-most point of the forefoot region 16, and a posterior end 24 corresponding to a rearward-most point of the heel region 20. A longitudinal axis $A_{10}$ of the footwear 10 extends along a length of the footwear 10 from the anterior end 22 to the posterior end 24, and generally divides the footwear 10 into a medial side 26 and a lateral side 28, as shown in FIG. 7. Accordingly, the medial side 26 and the lateral side 28 respectively correspond with opposite sides of the footwear 10 and extend through the regions 16, 18, 20.

With reference to FIGS. 1-4, the sole structure 12 includes a midsole 30 configured to provide cushioning characteristics to the sole structure 12 and an outsole 32 configured to provide a ground-engaging surface of the article of footwear 10. The midsole 30 of the sole structure 12 may be formed compositely and include a plurality of subcomponents for providing desired forms of cushioning and support throughout the sole structure 12. For example, the midsole 30 may include a bladder (not shown), disposed within the midsole 30. In one configuration, the bladder is encapsulated within a material of the midsole 30 and is disposed within the heel region 20. In another configuration, the bladder may be exposed at one or both of the medial side 26 and the lateral side 28. While the bladder is described as being disposed in the heel region 20, the bladder could alternatively be disposed in the midfoot region 18 or the forefoot region 20. Further, the bladder could be a so-called full-length bladder that extends continuously from the heel region 20 to the forefoot region 16. Finally, while the midsole 30 is described as including a bladder, the midsole 30 could be formed without a bladder altogether.

The bladder of the midsole 30 may include an opposing pair of barrier layers (not shown), which are joined to each other along a peripheral seam to define a chamber. The barrier layers may include a first, upper barrier layer defining an upper surface of the bladder and a second, lower barrier layer defining a lower surface of the bladder. Alternatively, the chamber can be produced from any suitable combination of one or more barrier layers, as described in greater detail below.

In some implementations, the upper barrier layer and the lower barrier layer cooperate to define a geometry (e.g., thicknesses, width, and lengths) of the chamber. For example the peripheral seam may bound and extend around the chamber to seal the fluid (e.g., air) within the chamber. Thus, the chamber is associated with an area of the bladder where interior surfaces of the upper and lower barrier layers are not joined together and, thus, are separated from one another. The bladder may include a peripheral surface that defines a peripheral profile of the bladder and extends between a top surface defined by the upper barrier layer and a bottom surface defined by the lower barrier layer.

A space formed between opposing interior surfaces of the upper and lower barrier layers defines an interior void of the chamber. Similarly, exterior surfaces of the upper and lower barrier layers define an exterior profile of the chamber. Thicknesses of the chamber are defined by the distance between the upper and lower barrier layers of the bladder.

As used herein, the term "barrier layer" encompasses both monolayer and multilayer films. In some embodiments, one or both of the barrier layers are each produced (e.g., thermoformed or blow molded) from a monolayer film (a single layer). In other embodiments, one or both of the barrier layers are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers include two or more sublayers, examples of suitable multilayer films include microlayer films, such as those disclosed in Bonk et al., U.S. Pat. No. 6,582,786, which is incorporated by reference in its entirety. In further embodiments, the barrier layers may each independently include alternating sublayers of one or more TPU copolymer materials and one or more EVOH copolymer materials, where the total number of sublayers in each of the barrier layers includes at least four (4) sublayers, at least ten (10) sublayers, at least twenty (20) sublayers, at least forty (40) sublayers, and/or at least sixty (60) sublayers.

The chamber can be produced from the barrier layers using any suitable technique, such as thermoforming (e.g. vacuum thermoforming), blow molding, extrusion, injection molding, vacuum molding, rotary molding, transfer molding, pressure forming, heat scaling, casting, low-pressure casting, spin casting, reaction injection molding, radio frequency (RF) welding, and the like. In an aspect, the barrier layers can be produced by co-extrusion followed by vacuum thermoforming to produce an inflatable chamber, which can optionally include one or more valves (e.g., one way valves) that allows the chamber to be filled with the fluid (e.g., gas).

The chamber can be provided in a fluid-filled (e.g., as provided in footwear 10) or in an unfilled state. The chamber can be filled to include any suitable fluid, such as a gas or liquid. In an aspect, the gas can include air, nitrogen ($N_2$), or any other suitable gas. In other aspects, the chamber can alternatively include other media, such as pellets, beads, ground recycled material, and the like (e.g., foamed beads and/or rubber beads). The fluid provided to the chamber can result in the chamber being pressurized. Alternatively, the fluid provided to the chamber can be at atmospheric pressure such that the chamber is not pressurized but, rather, simply contains a volume of fluid at atmospheric pressure.

The fluid-filled chamber desirably has a low gas transmission rate to preserve its retained gas pressure. In some embodiments, the fluid-filled chamber has a gas transmission rate for nitrogen gas that is at least about ten (10) times lower than a nitrogen gas transmission rate for a butyl rubber layer of substantially the same dimensions. In an aspect, fluid-filled chamber has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 114, 116). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

While the midsole 30 may include a bladder, the midsole 30 will be described and shown hereinafter without incorporating a bladder. The midsole 30 may be formed from a resilient polymeric material, such as foam or rubber, to impart properties of cushioning, responsiveness, and energy distribution to the foot of the wearer. Example resilient polymeric materials for the midsole 30 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With particular reference to FIGS. 4-7, the midsole 30 is shown as including a top surface 34 opposing the upper 14, a bottom surface 36 formed on an opposite side of the midsole 30 then the top surface 34 and opposing a ground surface during use, and a sidewall 38 extending between and connecting the top surface 34 and a bottom surface 36. As shown in FIG. 7, the top surface 34 extends continuously along the midsole 30 from the anterior end 22 of the sole structure 12 to the posterior end 24 of the sole structure 12. In one configuration, the top surface 34 may oppose a strobel (not shown) of the upper 14 when the midsole 30 is assembled to the upper 14.

Figure 8:
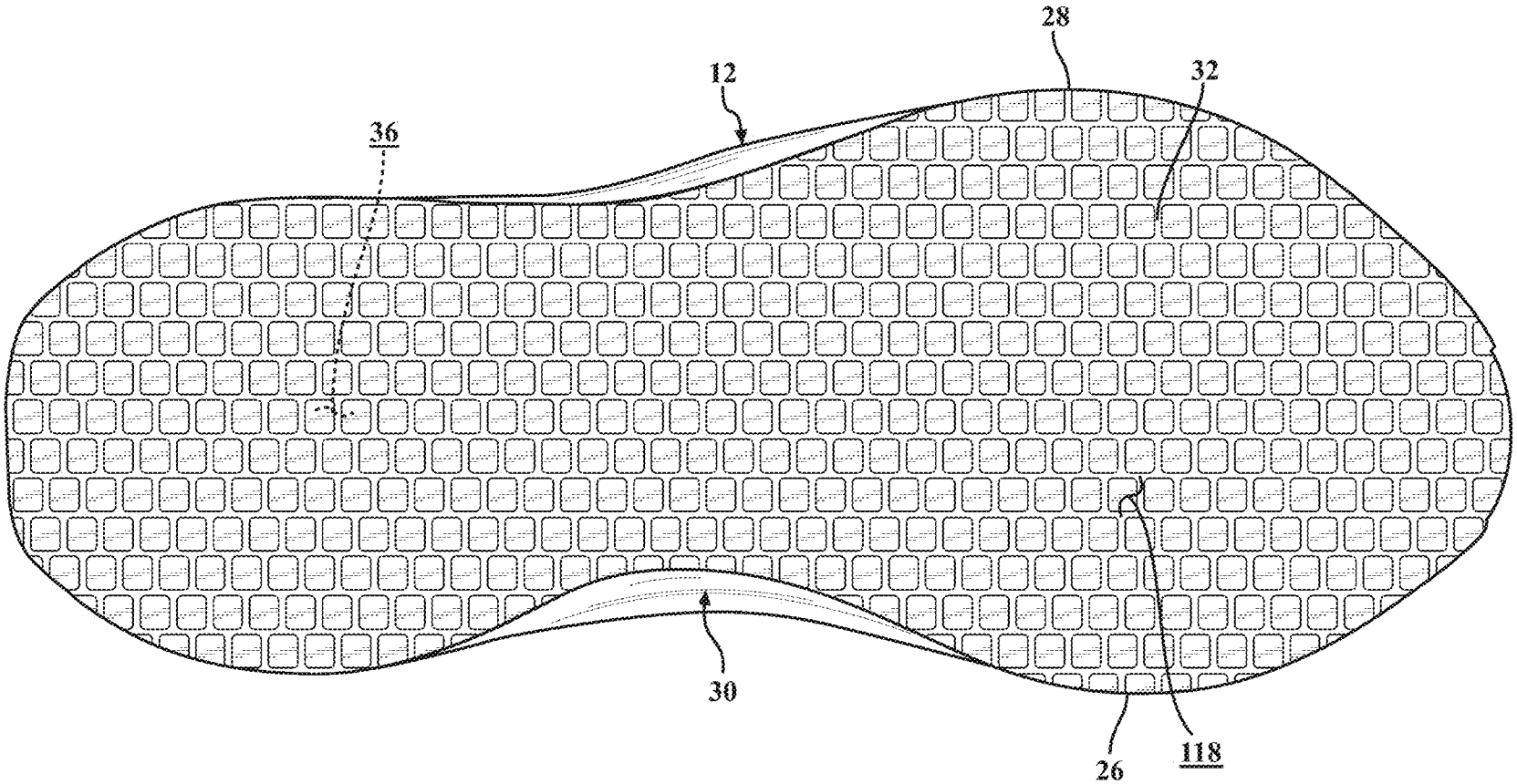
FIG. 8 is a bottom plan view of the sole structure of FIG. 1.

With particular reference to FIG. 8, the bottom surface 36 as is shown as being disposed on an opposite side of the midsole 30 then the top surface 34 and similarly extends from the anterior end 22 of the sole structure 12 to the posterior end 24 of the sole structure 12. The bottom surface 36 is attached to the outsole 32 when the outsole 32 is assembled to the midsole 30.

With particular reference to FIGS. 4-6 and 9-11, the sidewall 38 extends around a perimeter of the midsole 30 and generally defines the shape of the midsole 30. The sidewall 38 includes a first portion 40 disposed at the anterior end and 22 of the sole structure 12, a second portion 42 disposed at the posterior end 24 of the sole structure 12, a third portion 44 extending along the medial side 26 of the sole structure 12, and fourth portion 46 extending along the lateral side 28 of the sole structure 12.

Figure 2:
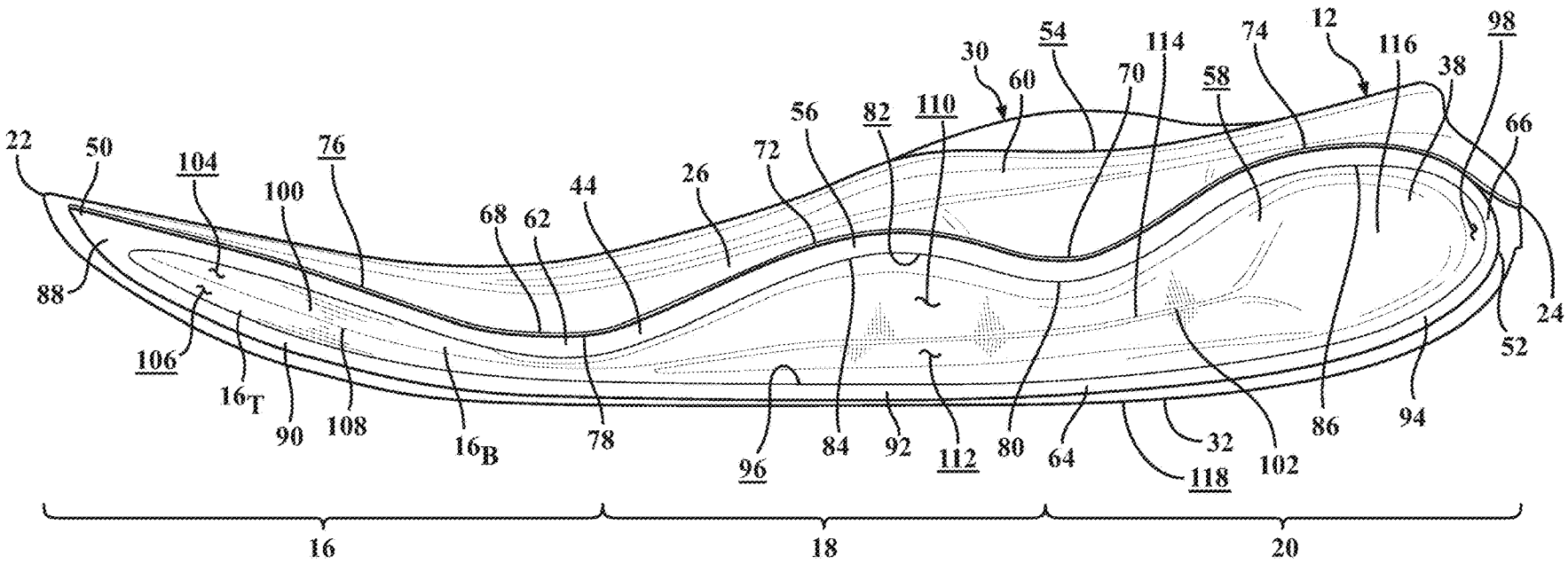
FIG. 2 is a medial side view of a sole structure of the article of footwear of FIG. 1.
Figure 3:
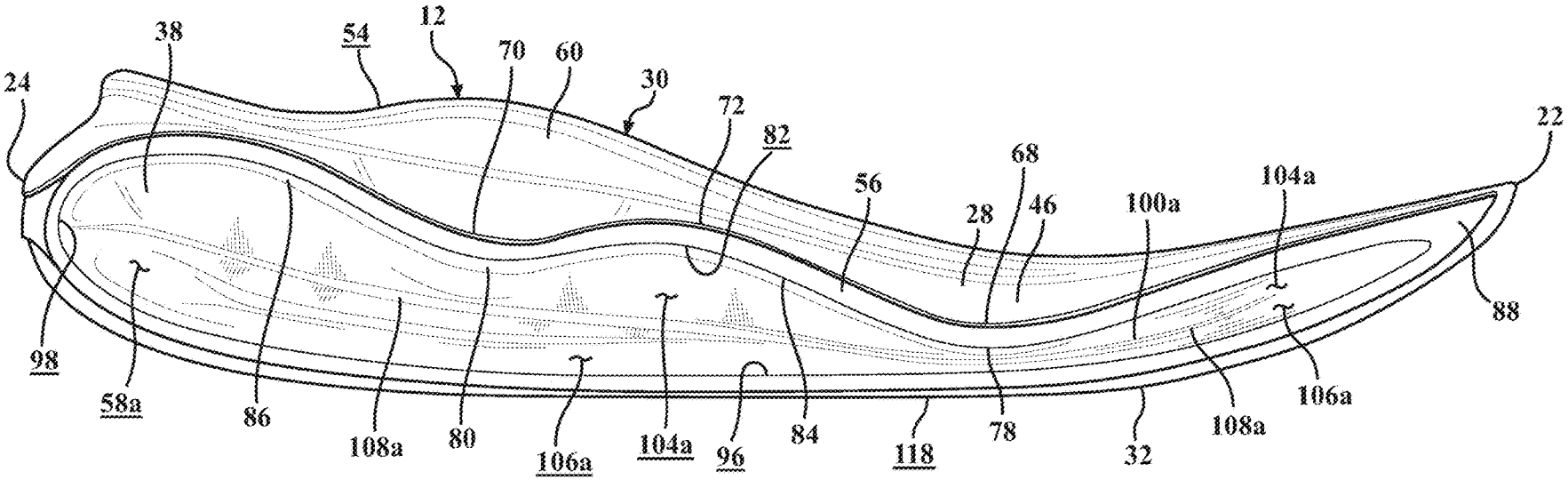
FIG. 3 is a lateral side view of a sole structure of the article of footwear of FIG. 1.
Figure 4:
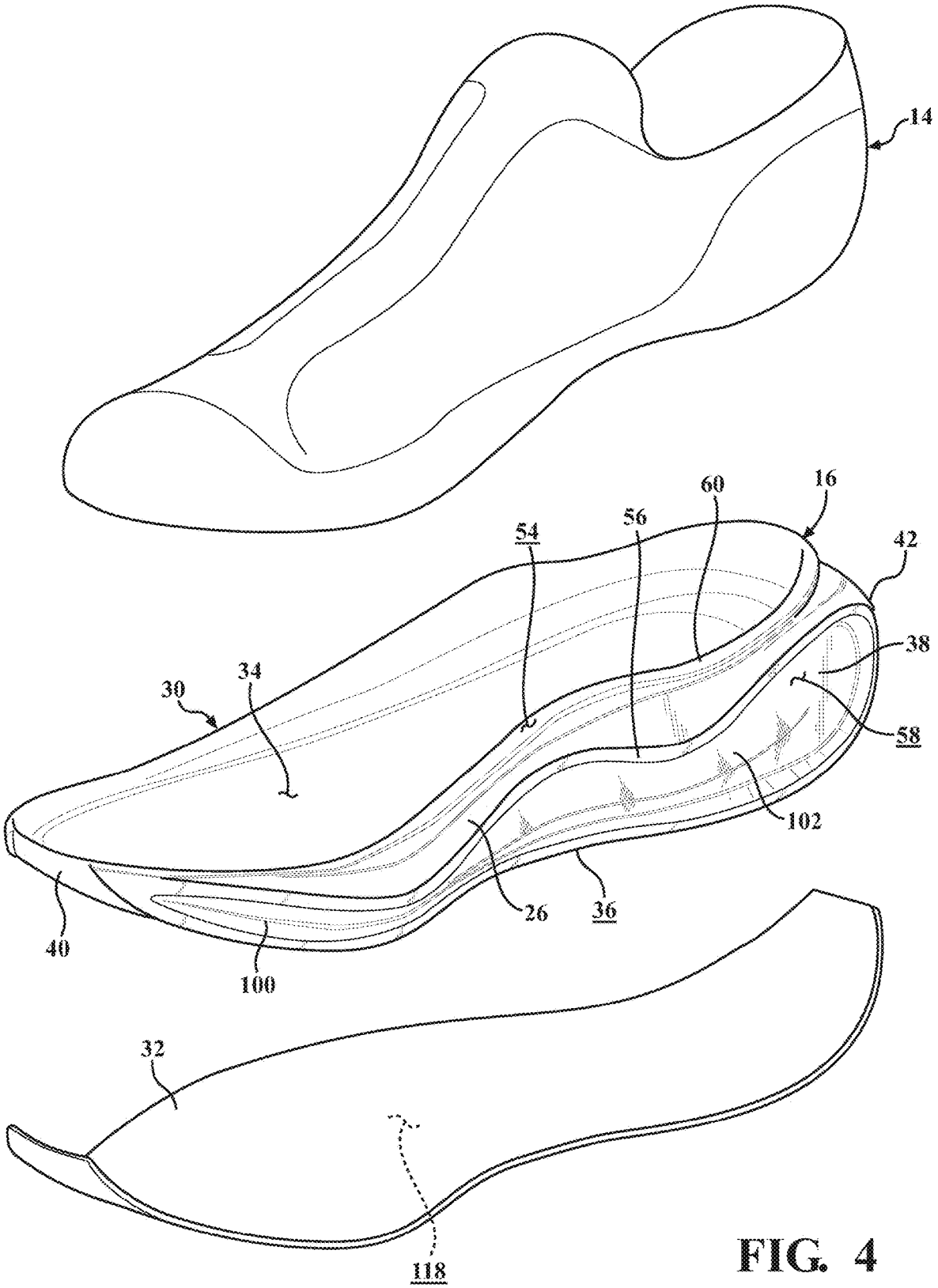
FIG. 4 is a top perspective exploded view of the sole structure of FIG. 1.

As shown in FIGS. 2 and 3, the first portion 40 defines a forward-most portion of the sole structure 12 and generally defines a shape of the anterior end 22 of the sole structure 12. In a similar fashion, the second portion 42 of the sidewall 38 defines a rearward-most portion of the sole structure 12 and generally defines a shape of the posterior end 24 of the sole structure 12. As such, the first portion 40 and the second portion 42 are disposed at opposite ends of the sole structure 12 such that the longitudinal axis $A_{10}$ extending along a length of the sole structure 12 passes through the first portion 40 and the second portion 42 (FIG. 7).

The third portion 44 of the sidewall 38 extends along the medial side 26 of the sole structure 12 between the first portion 40 of the sidewall 38 and the second portion 42 of the sidewall 38. The third portion 44 extends from a first end 50 located proximate to the first portion 40 at the anterior end 22 to a second end 52 located proximate to the second portion 42 at the posterior end 24. The third portion 44 includes an upper surface 54 disposed proximate to a junction of the midsole 30 and the upper 14, a projection 56 extending from the sidewall 38, and an undulating surface 58 extending within and contained by the projection 56.

The upper surface 54 defines an outer surface of the third portion 44 of the sidewall 38 and is disposed on a flange 60 extending from the top surface 34 of the midsole 30. The flange 60 extends from the anterior end 22 to the posterior end 24 and, in some configurations, increases in height in a direction extending from the anterior end 22 toward the posterior end 24. Accordingly, the flange 60 may extend from the top surface 34 of the midsole 30 to the greatest extent in the heel region 20. As will be described in greater detail below, the flange 60 extends continuously from a first end located within the forefoot region 16 on the medial side 26 to a second end located within the forefoot region at the lateral side 28. Accordingly, the flange 60 extends uninterrupted along the medial side 26 of the sole structure 12, around the posterior end 24 of the sole structure 12, and along the lateral side 28 of the sole structure 12. As shown, the flange 60 increases in height along the medial side 26 and the lateral side 28 in a direction from the forefoot region 16 to the midfoot region 18 such that the flange 60 extends from the top surface 34 of the midsole 32 to the greatest extent within the heel region 20. In so doing, the flange 60 may extend onto an outer surface of the upper 14 at a junction of the midsole 30 and the upper 14. Because the flange 60 extends from the top surface 34 of the midsole 30 to the greatest extent within the heel region 20, the flange 60 may extend further onto the upper 14 within the heel region 20 as compared to the forefoot region 16 and the midfoot region 18.

The projection 56 of the third portion 44 extends from the medial side 26 of the midsole 30 and is a closed-loop structure. The closed-loop structure of the projection 56 boarders and contains the undulating surface 58 at the medial side 26 of the sole structure 12. As shown, the projection 56 includes a first segment 62 extending proximate to the upper surface 54, a second segment 64 extending along and proximate to a junction of the bottom surface 36 of the midsole 30 and the sidewall 38, and a third segment 66 extending between and connecting the first segment 62 and the second segment 64. The first segment 62 includes an arcuate shape that undulates from the anterior end 22 to the posterior end 24 along the medial side 26 of the sole structure 12.

Specifically, the first segment 62 extends from the anterior end 22 and defines a first concave portion 68 disposed within the forefoot region 16, a second concave portion 70 spaced apart from the first concave portion 68 and disposed proximate to the midfoot region 18 and the heel region 20, a first convex portion 72 disposed between the first concave portion 68 and the second concave portion 70 within the midfoot region 18, and a second convex portion 74 disposed within the heel region 20 and between the second concave portion 70 and the posterior end 24 of the sole structure 12. The first concave portion 68, the second concave portion 70, the first convex portion 72, and the second convex portion 74 of the first segment 62 cooperate to define the overall shape of the first segment 62 and are defined relative to a top surface 76 of the projection 56 facing in a direction toward the upper 14. Specifically, the top surface 76 is concave at elements 68 and 70 and is convex at elements 72 and 74. Because the projection 56 includes a substantially uniform thickness, the first concave portion 68 and the second concave portion 70 cause the projection 56 to define a third convex portion 78 at the first concave portion 68 and a fourth convex portion 80 at the second concave portion 70, whereby the third convex portion 78 and the fourth convex portion 80 are defined by an inner surface 82 of the projection 56. Likewise, a third concave portion 84 is defined at the inner surface 82 at the first convex portion 72 and a fourth concave portion 86 is defined by the second convex portion 74 at the inner surface 82. As shown in FIGS. 2 and 5, the inner surface 82 opposes and borders the undulating surface 58 such that the third convex portion 78, the fourth convex portion 80, the third concave portion 84, and the fourth concave portion 86 border and oppose the undulating surface 58 at a junction of the inner surface 82 of the projection 56 and the undulating surface 58.

The second segment 64 of the projection 56 extends from a junction 88 of the second segment 64 and the first segment 62 at the anterior end 22 to the third segment 66 disposed within the heel region 20. The second segment 64 includes an arcuate first portion 90 extending from the junction 88 in a direction away from the upper 14, a substantially planar second portion 92 extending from the first portion 90 proximate to and along a junction of the bottom surface 36 of the midsole 30 and the sidewall 38, and an arcuate third portion 94 extending from the second portion 92 to the third segment 66 in a direction toward the upper 14. As with the first segment 62, the second segment 64 includes an inner surface 96 extending along a length of the second segment 64 and along the first portion 90, the second portion 92, and the third portion 94. As shown in FIG. 2, the inner surface 96 of second segment 64 is spaced apart from and opposes the inner surface 82 of the first segment 62. Because the first segment 62 undulates from the anterior end 22 to the posterior end 24, a distance between the inner surface 82 of the first segment 62 and the inner surface 96 of the second segment 64 varies along a length of the sidewall 38.

The third segment 66 of the projection 56 extends between and connects the first segment 62 and the second segment 64 in the heel region 20. Specifically, the third segment 66 includes an arcuate shape extending between and connecting the first segment 62 and the second segment 64. As shown, the third segment 66 is disposed at an opposite end of the projection 56 then the junction 88 between the first segment 62 and the second segment 64. Accordingly, the projection 56 extends along a length of the sidewall 38 from the junction 88 within the forefoot region 16 to the third segment 66 in the heel region 20. Finally, the third segment 66 includes and inner surface 98 that extends between and joins the inner surface 82 of the first segment 62 and the inner surface 96 of the second segment 64. Accordingly, the inner surfaces 82, 96, 98, cooperate to define an inner periphery of the projection 56 and cooperate to bound the undulating surface 58.

Figure 11:
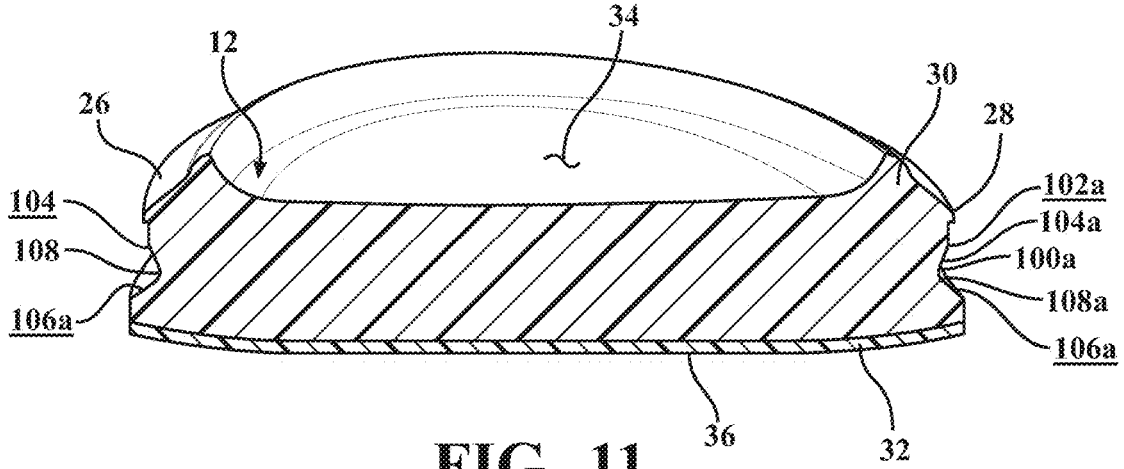
FIG. 11 is a lateral cross-sectional view of the sole structure of FIG. 1, taken along Line 11-11 of FIG. 7.

The undulating surface 58 includes a concave portion 100 disposed within the forefoot region 16 and a convex portion 102 disposed between the concave portion 100 and the posterior end 24 of the sole structure 12. The concave portion 100 extends from a junction of the inner surface 82 of the first segment 62 and the inner surface 96 of the second segment 64 to the convex portion 102 proximate to a junction of the forefoot region 16 and the midfoot region 18. The concave portion 100 is defined by a first surface 104 and a second surface 106 that meet at a junction 108. Specifically, the first surface 104 extends from the inner surface 82 of the first segment 62 in a direction towards the outsole 32 while the second surface 106 extends in a direction away from the inner surface 96 of the second segment 64 toward the upper 14. The first surface 104 extends from the inner surface 82 of the first segment 62 in a direction toward the outsole 32 and in a direction toward the lateral side 28 of the sole structure 12. Similarly, the second surface 106 extends in a direction away from the inner surface 96 of the second segment 64 toward the upper 14 and in a direction toward the lateral side 28 of the sole structure 12. Accordingly, the junction 108 of the first surface 104 and the second surface 106 is disposed closer to the lateral side 28 then any portion of the projection 56, thereby providing the sole structure 12 with a concavity in the forefoot region 16. As shown, the first surface 104 and the second surface 106 may be substantially planar such that the concave portion 100 includes a substantially V-shape within the forefoot region 16, as shown in FIG. 11.

Figure 9:
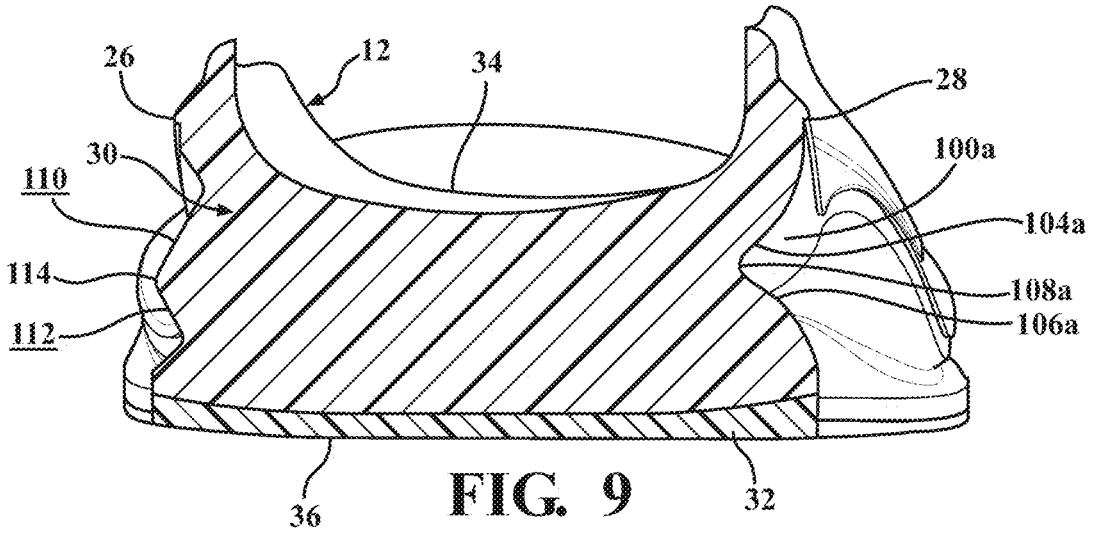
FIG. 9 is a lateral cross-sectional view of the sole structure of FIG. 1, taken along Line 9-9 of FIG. 7.

The convex portion 102 of the undulating surface 58 extends from the concave portion 100 proximate to a junction of the forefoot region 16 and the midfoot region 18 of the sole structure 12 in a direction toward the posterior end 24. The convex portion 102 extends from the concave portion 100, through the midfoot region 18, and into the heel region 20. The convex portion 102 is defined by a first surface 110 extending from the inner surface 82 of the first segment 62 and a second surface 112 extending from the inner surface 96 of the second segment 64. Specifically, the first surface 110 extends from the inner surface 82 in a direction toward the outsole 32 while the second surface 112 extends from the inner surface 96 of the second segment 64 in a direction toward the upper 14. The first surface 110 and the second surface 112 also extend in a direction away from the lateral side 28 and meet at a junction 114, as shown in FIG. 9. The junction 114 defines an apex of the convex portion 102 and extends along a length of the convex portion 102.

As shown in FIGS. 2 and 5, the first surface 110 and the second surface 112 are substantially planar and, as such, the first surface 110 and the second surface 112 provide the convex portion 102 with a substantially V-shape along a length of the convex portion 102. While the first surface 110 and the second surface 112 are described as being substantially planar such that the convex portion 102 includes a substantially V-shape at any given cross-section of the convex portion 102 along its length, the first surface 110 and the second surface 112 may undulate along a length of the convex portion 102.

The convex portion 102 extends from the concave portion 100 to a substantially flat region 116 of the undulating surface 58 located within the heel region 20. The substantially flat region 116 is bounded by the first segment 62, the second segment 64, and the third segment 66 of the projection 56 within the heel region 20. In one configuration, the convex portion 102 tapers in a direction from the junction or apex 108 toward the posterior end 24 to form the substantially flat region 116.

With particular reference to FIGS. 3 and 6, the fourth portion 46 of the sidewall 38 is shown as extending along a length of the midsole 30 from the anterior end 22 to the posterior end 24. In view of the substantial similarity in structure and function of the fourth portion 46 with respect to the third portion 44, like reference numerals are used hereafter in the drawings to identify like components while reference numbers containing letter extensions are used to identify those components that have been modified.

As with the third portion 44, the fourth portion 46 includes the projection 56 having the first segment 62, the second segment 64, and the third segment 66 cooperating to define the first concave portion 68, the second concave portion 70, the first convex portion 72, and the second convex portion 74. As such, the projection 56 of the fourth portion 46 likewise includes the third convex portion 78, the fourth convex portion 80, the third concave portion 84, and the fourth concave portion 86. The first segment 62, the second segment 64, and the third segment 66 of the projection 56 associated with the fourth portion 46 may be aligned with the respective first segment 62, second segment 64, and third segment 66 of the projection 56 associated with the third portion 44 across a width of the midsole 30.

Figure 10:
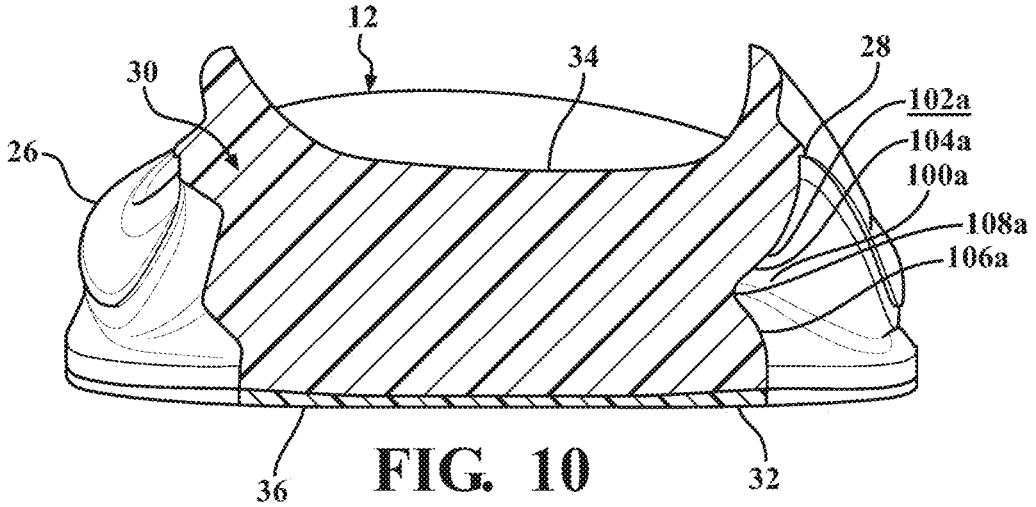
FIG. 10 is a lateral cross-sectional view of the sole structure of FIG. 1, taken along Line 10-10 of FIG. 7.

The projection 56 of fourth portion 46 also includes the inner surface 82 associated with the first segment 62, the inner surface 96 associated with the second segment 64, and the inner surface 98 associated with the third segment 66. The surfaces 82, 96, 98, cooperate to bound the undulating surface 58*a* along the lateral side 28 of the sole structure 12. The undulating surface 58*a* is defined by a concave portion 100*a* having a first surface 104*a* and a second surface 106*a* that meet at a junction 108*a*. The first surface 104*a* extends from the inner surface 82 of the first segment 62 in a direction toward the outsole 32. The second surface 106*a* extends in a direction away from the outsole 32 toward the upper 14 and intersects the first surface 104*a* at a junction 108*a*. As shown, the junction 108*a* extends from the junction 88 in the forefoot region 16 along a length of the undulating surface 58*a* into the heel region 20. Accordingly, the concave portion 100*a* of the fourth portion 46 extends along substantially the entire length of the fourth portion 46 at the lateral side 28. In one configuration, the junction 108*a* of the concave portion 100*a* may be aligned with the junction 108 of the concave portion 100 of the third portion 44 across a width of the midsole 30 within the forefoot region 16. Similarly, the junction 108*a* of the concave portion 100*a* may be aligned with the junction or apex 114 of the convex portion 102 across a width of the midsole 30 within the midfoot region 18 and the heel region 20. These relationships are shown in FIGS. 9-11.

The outsole 32 is attached to the midsole 30 at the bottom surface 36 of the midsole 30 proximate to the sidewall 38 at the first portion 40, the second portion 42, the third portion 44, and the fourth portion 46. The outsole 32 includes a first side attached to the bottom surface 36 and a second side disposed on an opposite side of the outsole 32 then the first side. The outsole 32 defines a ground-engaging surface 118 at the second side of the outsole 32 to provide the sole structure 12 and, thus, the article of footwear 10, with abrasion resistance and traction during use.

As described, the midsole 30 provides the sole structure 12 with a concave portion at the sidewall 38 within the forefoot region 16 at both the medial side 26 and the lateral side 28. The midsole 30 also provides the sole structure 12 with a concave portion at the sidewall 38 in the midfoot region 18 and the heel region 20 at the lateral side 28 of the sole structure 12 and provides the sole structure 12 with a convex portion at the sidewall 38 in the midfoot region 18 and the heel region 20 at the medial side 26. In one configuration, the concave portion formed in the sidewall 38 at the lateral side 28 may be aligned with the convex portion of the undulating surface 58 at the medial side 26. In short, the midsole 30 may provide the sole structure 12 with a concave portion at the midfoot region 18 and the heel region 20 that is aligned with a convex portion in the midfoot region 18 and the heel region 20 at the medial side 26.

The following Clauses provide exemplary configurations for a sole structure for an article of footwear and an article of footwear described above.

Clause 1. A sole structure for an article of footwear, the sole structure comprising a midsole including a first surface, a second surface disposed on an opposite side of the midsole than the first surface and opposing a ground surface during use, and a sidewall extending between and connecting the first surface and the second surface, the sidewall including (i) a first portion extending along one of a medial side of the sole structure and a lateral side of the sole structure and including a first concave portion in a forefoot region and a convex portion in a heel region and (ii) a second portion extending along the other of the medial side of the sole structure and the lateral side of the sole structure and including a second concave portion extending from the forefoot region to the heel region.

Clause 2. The sole structure of Clause 1, wherein the first concave portion is aligned with the second concave portion across a width of the sole structure.

Clause 3. The sole structure of any of the preceding Clauses, wherein the convex portion is disposed in the heel region of the sole structure.

Clause 4. The sole structure of any of the preceding Clauses, wherein the convex portion extends from a midfoot region of the sole structure into a heel region of the sole structure.

Clause 5. The sole structure of any of the preceding Clauses, wherein the first concave portion extends continuously from the forefoot region to a midfoot region of the sole structure and the convex portion extends continuously from the first concave portion into the heel region.

Clause 6. The sole structure of any of the preceding Clauses, wherein the first concave portion is defined by a first substantially planar surface and a second substantially planar surface that meet at a first junction to define a depth of the first concave portion.

Clause 7. The sole structure of Clause 6, wherein the convex portion is defined by a third substantially planar surface and a second substantially planar surface that meet at an apex to define a height of the convex portion.

Clause 8. The sole structure of Clause 7, wherein the apex is aligned with the first junction of the first concave portion.

Clause 9. The sole structure of Clause 7, wherein the second concave portion is defined by a fifth substantially planar surface and a sixth substantially planar surface that meet at a second junction to define a depth of the second concave portion, the second junction being aligned with the apex of the convex portion across a width of the sole structure.

Clause 10. An article of footwear incorporating the sole structure of any of the preceding Clauses.

Clause 11. A sole structure for an article of footwear, the sole structure comprising: a midsole including a first surface, a second surface disposed on an opposite side of the midsole than the first surface and opposing a ground surface during use, and a sidewall extending between and connecting the first surface and the second surface, the sidewall including (i) a first portion extending along one of a medial side of the sole structure and a lateral side of the sole structure and including a first concave portion in a forefoot region and a convex portion in a heel region and (ii) a second portion extending along the other of the medial side of the sole structure and the lateral side of the sole structure and including a second concave portion aligned with the first concave portion and the convex portion across a width of the sole structure.

Clause 12. The sole structure of Clause 11, wherein the first concave portion and the second concave portion have substantially the same size and shape.

Clause 13. The sole structure of any of the preceding Clauses, wherein the convex portion is disposed in the heel region of the sole structure.

Clause 14. The sole structure of any of the preceding Clauses, wherein the convex portion extends from a midfoot region of the sole structure into a heel region of the sole structure.

Clause 15. The sole structure of any of the preceding Clauses, wherein the first concave portion extends continuously from the forefoot region to a midfoot region of the sole structure and the convex portion extends continuously from the first concave portion into the heel region.

Clause 16. The sole structure of any of the preceding Clauses, wherein the first concave portion is defined by a first substantially planar surface and a second substantially planar surface that meet at a first junction to define a depth of the first concave portion.

Clause 17. The sole structure of Clause 16, wherein the convex portion is defined by a third substantially planar surface and a second substantially planar surface that meet at an apex to define a height of the convex portion.

Clause 18. The sole structure of Clause 17, wherein the apex is aligned with the first junction of the first concave portion.

Clause 19. The sole structure of Clause 17, wherein the second concave portion is defined by a fifth substantially planar surface and a sixth substantially planar surface that meet at a second junction to define a depth of the second concave portion, the second junction being aligned with the apex of the convex portion across a width of the sole structure.

Clause 20. An article of footwear incorporating the sole structure of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a midsole including a first surface, a second surface disposed on an opposite side of the midsole than the first surface and opposing a ground surface during use, and a sidewall extending between and connecting the first surface and the second surface, the sidewall including:

a projection including a first segment extending proximate to the first surface and including an inner surface, a second segment extending proximate to the second surface and including an inner surface spaced apart from and opposing the inner surface of the first segment, and a third segment including an inner surface extending between and connecting the first segment and the second segment in a heel region, the inner surface of the first segment and the inner surface of the second segment each extending from a first junction of the first segment and the second segment at an anterior end to the inner surface of the third segment; and (i) a first portion extending along one of a medial side of the sole structure and a lateral side of the sole structure and including a first undulating surface bounded by the projection and extending continuously between the first junction and the third segment, the first undulating surface including a first concave portion in a forefoot region and a convex portion in the heel region and (ii) a second portion extending along the other of the medial side of the sole structure and the lateral side of the sole structure and including a second undulating surface bounded by the projection and extending continuously between the first junction and the third segment, the second undulating surface including a second concave portion extending from the forefoot region to the heel region.

2. The sole structure of claim 1, wherein the first concave portion is aligned with the second concave portion across a width of the sole structure.

3. The sole structure of claim 1, wherein the convex portion is disposed in the heel region of the sole structure.

4. The sole structure of claim 1, wherein the convex portion extends from a midfoot region of the sole structure into the heel region of the sole structure.

5. The sole structure of claim 1, wherein the first concave portion extends continuously from the forefoot region to a midfoot region of the sole structure and the convex portion extends continuously from the first concave portion into the heel region.

6. The sole structure of claim 1, wherein the first concave portion is defined by a first substantially planar surface and a second substantially planar surface that meet at a second junction to define a depth of the first concave portion.

7. The sole structure of claim 6, wherein the convex portion is defined by a third substantially planar surface and a fourth substantially planar surface that meet at an apex to define a height of the convex portion.

8. The sole structure of claim 7, wherein the apex is aligned with the second junction of the first concave portion.

9. The sole structure of claim 7, wherein the second concave portion is defined by a fifth substantially planar surface and a sixth substantially planar surface that meet at a third junction to define a depth of the second concave portion, the third junction being aligned with the apex of the convex portion across a width of the sole structure.

10. An article of footwear incorporating the sole structure of claim 1.

11. A sole structure for an article of footwear, the sole structure comprising:

a midsole including a first surface, a second surface disposed on an opposite side of the midsole than the first surface and opposing a ground surface during use, and a sidewall extending between and connecting the first surface and the second surface, the sidewall including:

a projection including a first segment extending proximate to the first surface and including an inner surface, a second segment extending proximate to the second surface and including an inner surface spaced apart from and opposing the inner surface of the first segment, and a third segment including an inner surface extending between and connecting the first segment and the second segment in a heel region, the inner surface of the first segment and the inner surface of the second segment each extending from a first junction of the first segment and the second segment at an anterior end to the inner surface of the third segment; and (i) a first portion extending along one of a medial side of the sole structure and a lateral side of the sole structure and including a first undulating surface bounded by the projection and extending continuously between the first junction and the third segment, the first undulating surface including a first concave portion in a forefoot region and a convex portion in the heel region and (ii) a second portion extending along the other of the medial side of the sole structure and the lateral side of the sole structure and including a second undulating surface bounded by the projection and extending continuously between the first junction and the third segment, the second undulating surface including a second concave portion aligned with the first concave portion and the convex portion across a width of the sole structure.

12. The sole structure of claim 11, wherein the first concave portion and the second concave portion have substantially the same size and shape.

13. The sole structure of claim 11, wherein the convex portion is disposed in the heel region of the sole structure.

14. The sole structure of claim 11, wherein the convex portion extends from a midfoot region of the sole structure into the heel region of the sole structure.

15. The sole structure of claim 11, wherein the first concave portion extends continuously from the forefoot region to a midfoot region of the sole structure and the convex portion extends continuously from the first concave portion into the heel region.

16. The sole structure of claim 11, wherein the first concave portion is defined by a first substantially planar surface and a second substantially planar surface that meet at a second junction to define a depth of the first concave portion.

17. The sole structure of claim 16, wherein the convex portion is defined by a third substantially planar surface and a fourth substantially planar surface that meet at an apex to define a height of the convex portion.

18. The sole structure of claim 17, wherein the apex is aligned with the second junction of the first concave portion.

19. The sole structure of claim 17, wherein the second concave portion is defined by a fifth substantially planar surface and a sixth substantially planar surface that meet at a third junction to define a depth of the second concave portion, the third junction being aligned with the apex of the convex portion across the width of the sole structure.

20. An article of footwear incorporating the sole structure of claim 11.

* * * * *